US005609473A

United States Patent [19]

Litvin

[11] Patent Number: 5,609,473

[45] Date of Patent: Mar. 11, 1997

[54] PIVOT FAN

[76] Inventor: Charles Litvin, 1065 Stable La., West Chester, Pa. 19382

[21] Appl. No.: 614,527

[22] Filed: Mar. 13, 1996

[51] Int. Cl.[6] ..... F04D 29/64

[52] U.S. Cl. ..... 416/246; 416/247 R; 416/244 R

[58] Field of Search ..... 416/244 R, 246, 416/247 R; 415/213.1

[56] References Cited

U.S. PATENT DOCUMENTS

| | | | |
|---|---|---|---|
| 2,123,448 | 7/1938 | Weber | 416/247 |
| 2,904,298 | 9/1959 | Tateishi | 416/244 R |
| 2,954,198 | 9/1960 | Lindberg et al. | 416/246 |
| 4,486,144 | 12/1984 | Hung | 416/247 R |
| 5,368,445 | 11/1994 | Litvin et al. | 416/246 |
| 5,431,544 | 7/1995 | Hsu et al. | 416/247 R |

*Primary Examiner*—Edward K. Look
*Assistant Examiner*—Mark Sgantzos
*Attorney, Agent, or Firm*—Zachary T. Wobensmith, III

[57] ABSTRACT

A pivot fan which has an improved yoke and base assembly, which is easy to mold, of improved structural design, uses less material in construction, which includes a one piece molded base with a yoke, a portion of which is integral with the base and with two members which are engaged in recesses in each side of the base, and support a fan outer housing, which is retained in the yoke, and tiltable for air direction variance, which housing has an integral handle, and contains a fan motor and blade to provide airflow.

4 Claims, 8 Drawing Sheets

PIVOT FAN

BACKGROUND OF THE INVENTION

FIELD OF THE INVENTION

This invention relates to a pivot fan of the type which has a molded, multipiece yoke and base assembly.

DESCRIPTION OF THE PRIOR ART

Pivot fans have long been known in the prior art. Such fans include a base which sits on the floor, and a yoke that supports a tiltable fan outer housing that contains a motor and fan blade to provide airflow. There have been numerous base and yoke constructions proposed which attempt to provide a structure that is moldable, and which supports the fan outer housing. One approach has been to split the base in half, which results in molding problems and often, the parts do not fit together properly, are unsightly with a visible line down the middle, and are difficult to retain together.

It has also been proposed to mold a base piece and use a one piece yoke, which is bolted to the base, but structural considerations require more material, increase the weight and expense.

The pivot fan yoke and base assembly of the invention is easy to mold, saves material, weight and expense, is of an improved structural design, and has other positive advantages.

SUMMARY OF THE INVENTION

This invention relates to a pivot fan which has a multipiece base and yoke assembly, where the yoke is of two pieces, with portions which fit into recesses in the base, interlock therein, and support the outer fan housing, which contains the fan motor and blade.

The principal object of the invention is to provide a base and yoke assembly for pivot fans that is of improved structural integrity and provides a pleasing appearance.

A further object of the invention iS to provide a base and yoke assembly of the character aforesaid that is easy to mold and offers material savings.

A further object of the invention is to provide a base and yoke assembly of the character aforesaid that is easy to assemble and use.

A further object of the invention is to provide a base and yoke assembly that is suitable for mass production.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications, combinations and changes can be made in the structures disclosed without departing from the spirit of the invention.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Figure 1:
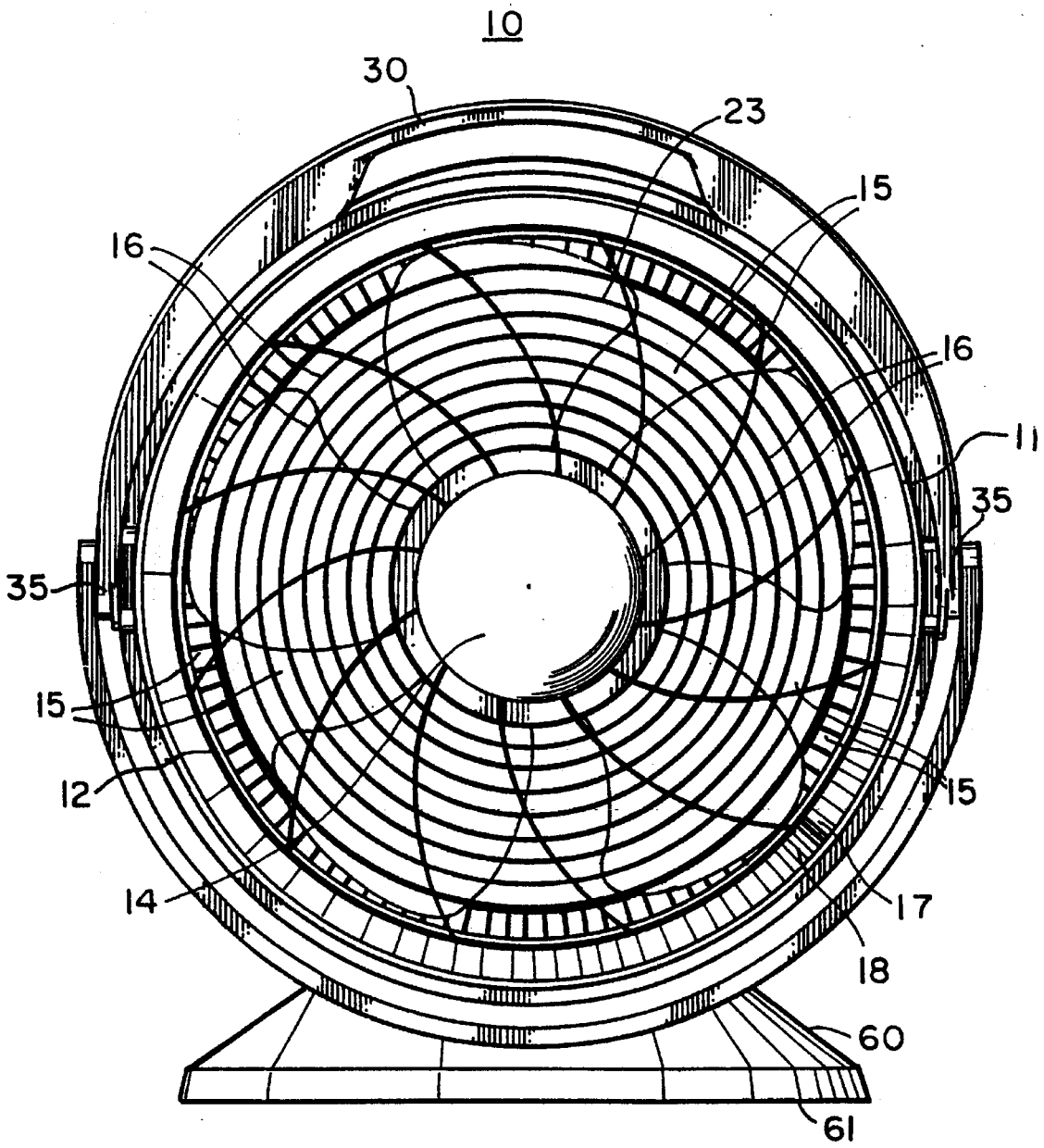
FIG. 1 is a front elevational view of a pivot fan incorporating the base and yoke assembly of the invention.
Figure 2:
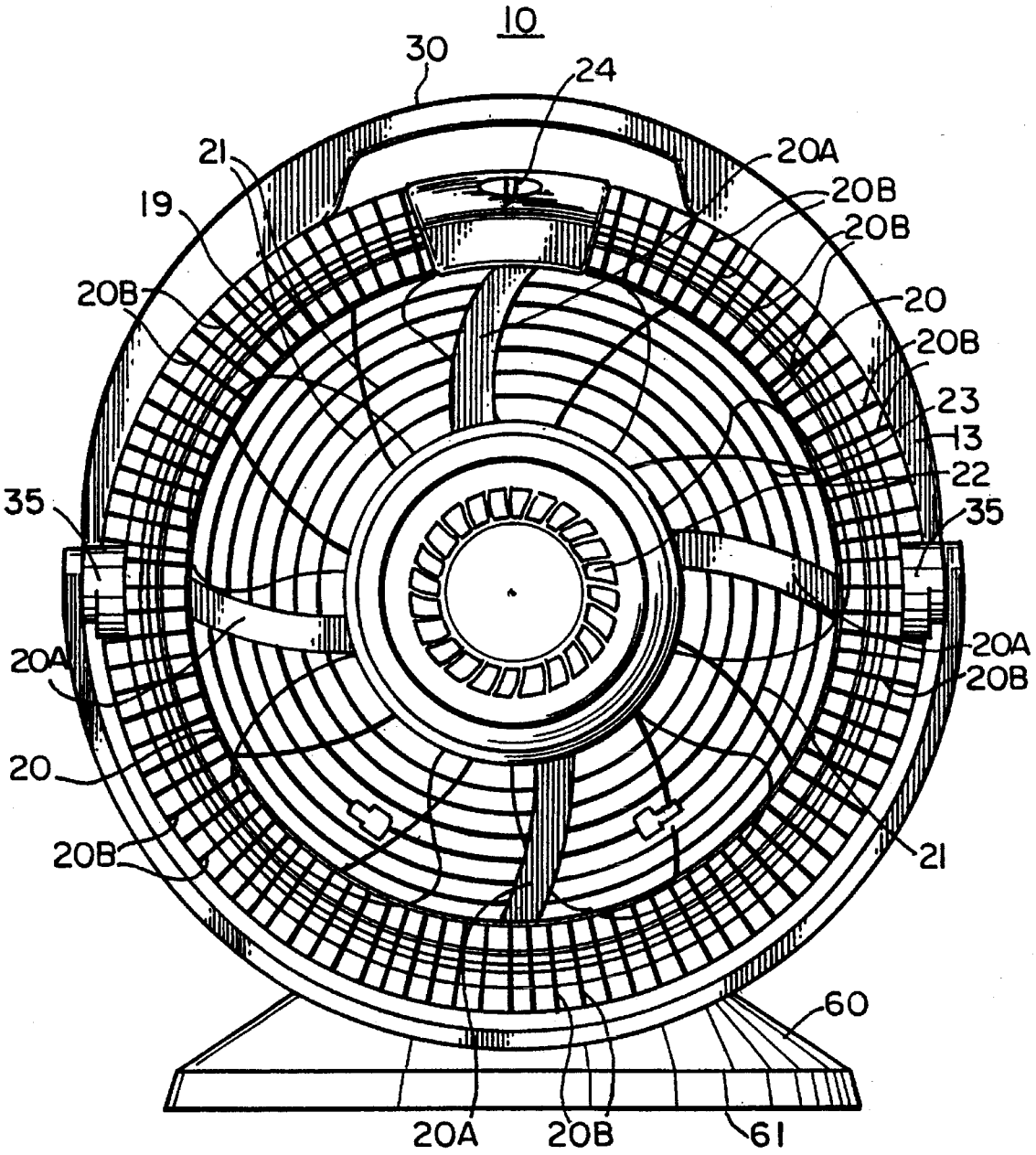
FIG. 2 is a rear view of the assembly of FIG. 1.
Figure 3:
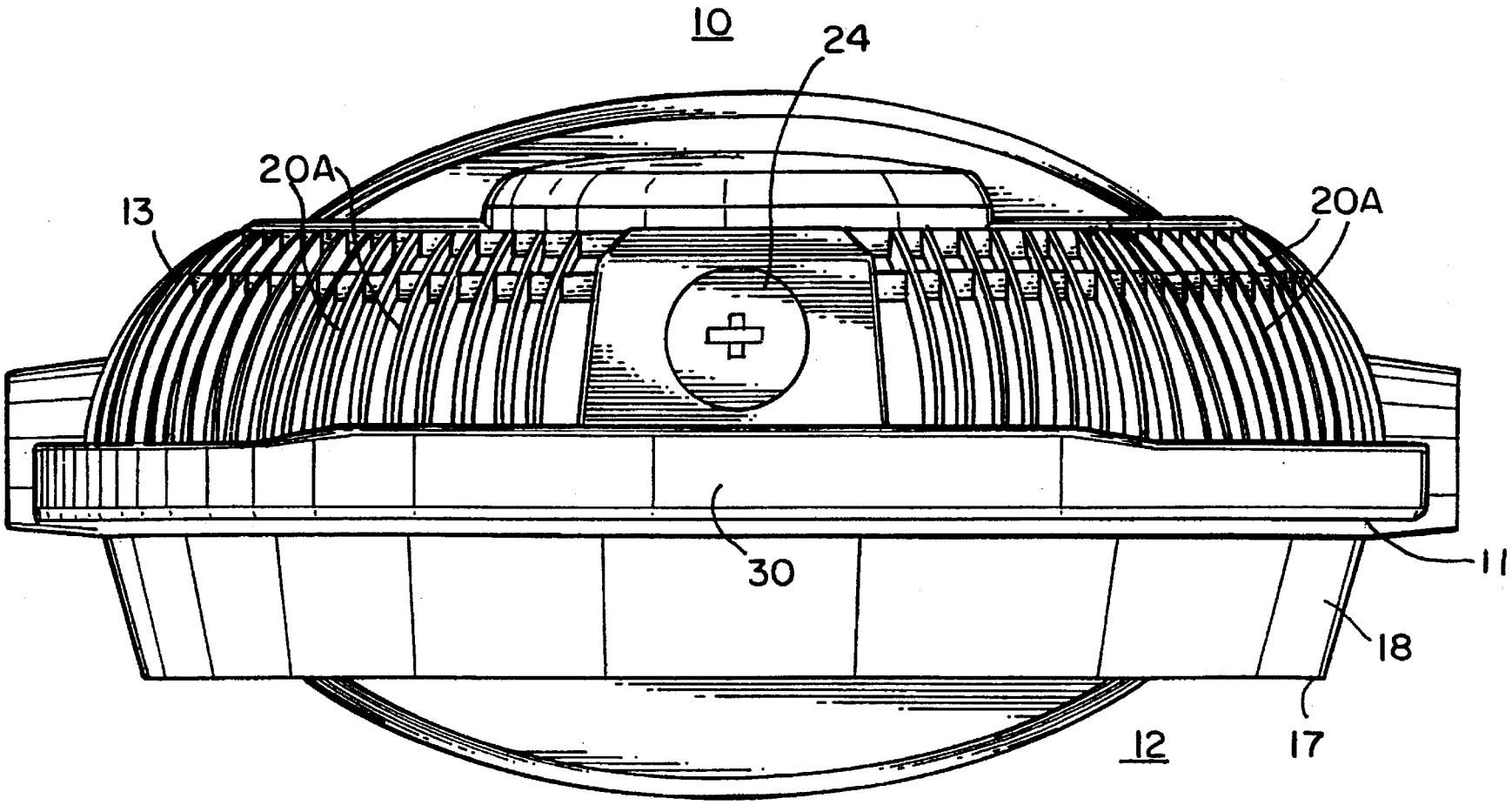
FIG. 3 is a top elevational view of the assembly of FIG. 1.

Referring now more particularly to FIGS. 1 and 2 of the drawings, a pivot fan 10 is therein illustrated. The fan 10 includes an outer housing 11 with a front half.12 and a rear half 13, of circular configuration, which front half 12 has a circular face plate 14 with a plurality of integral ribs 15 extending therefrom, with a plurality of circular ribs 16 integral therewith, which extend to an edge 17 of an outer wall 18 of front half 12.

The rear half 13 of housing 11 has an outer wall 19, which has a plurality of integral ribs 20, 20A and 20B extending therefrom, with a plurality of circular ribs 21 integral therewith, which extend to a rear plate 22 to which a motor (not shown), is mounted and which has a fan blade 23 mounted thereto. The motor (not shown) is connected in well known manner by wires (not shown) to a source of electricity (not shown), and with a switch 24 to control the fan motor (not shown) operation. The housing 11 has a carrying handle 30 attached thereto, of half circle shape.

Figure 9:
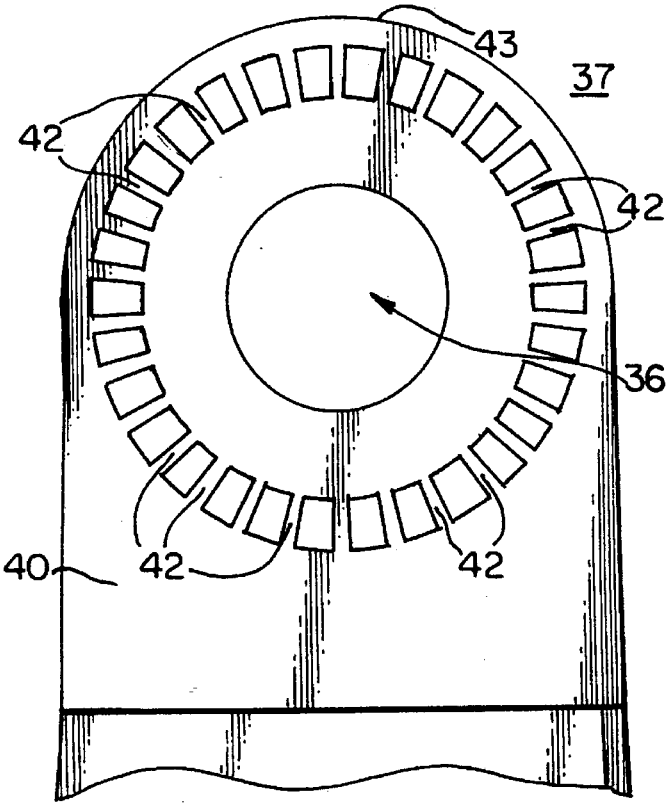
FIG. 9 is a fragmentary sectional view, enlarged, taken approximately on the line 9—9 of FIG. 8.
Figure 8:
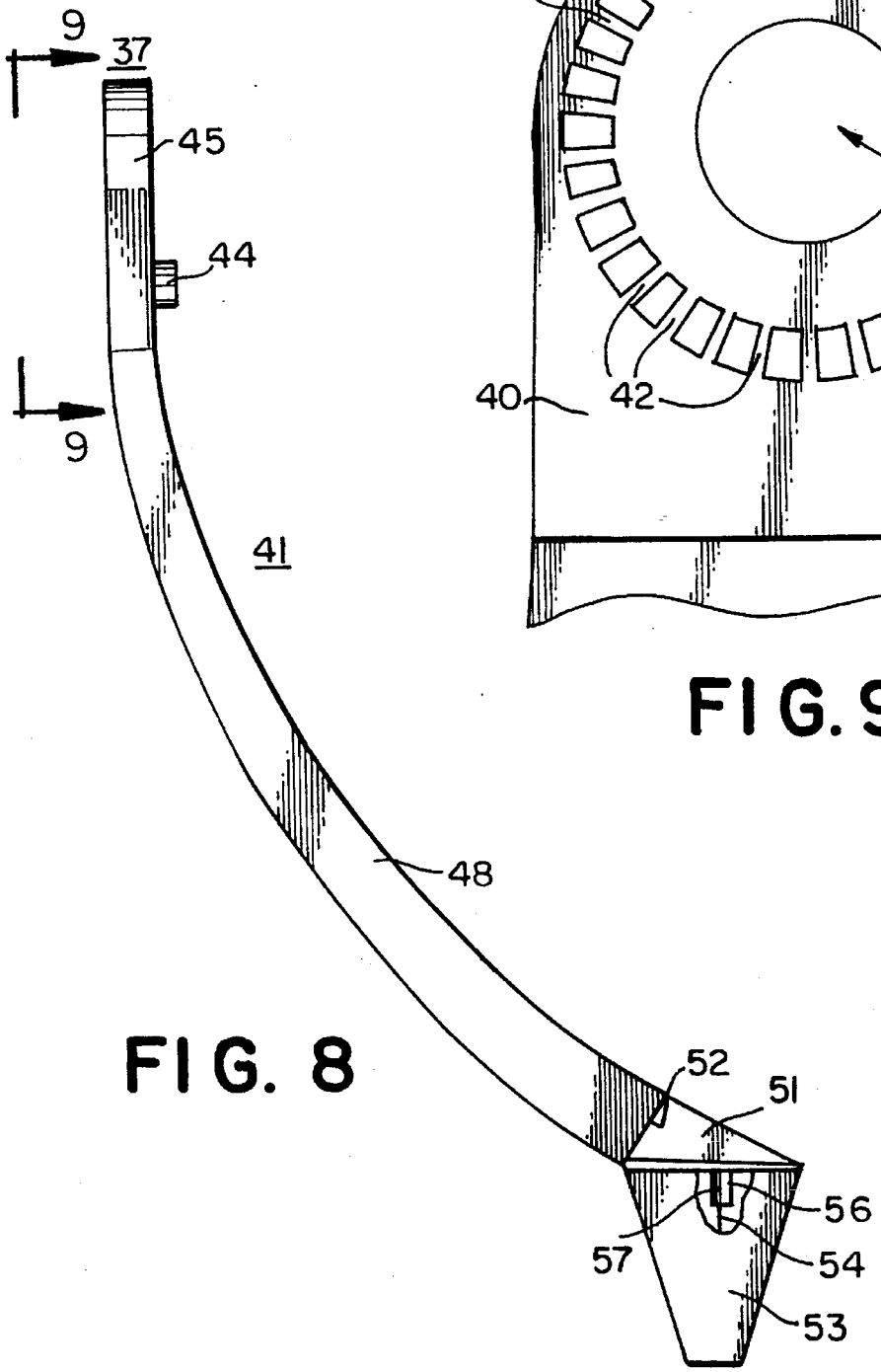
FIG. 8 is a side-elevational view of the yoke member of FIG. 7.

Referring additionally to FIGS. 4–9, the housing 11 at each side at the termination of handle 30, has a boss 35 with a portion (not shown) engaged in an opening 36, in an end portion 37 of a centerplate 40 of a yoke member 41. The plate 40 has a plurality of radial ribs 42 as seen in FIG. 9, with which ribs (not shown) from an end cap (not shown) are engaged to permit rotation of the housing 11, with distinct stop positions.

The yoke member 41 is of circular configuration, with the end portion 3 having a rounded end 43, and a raised stop piece 44 which restrains the rotation of housing 11. The end portion 37 has a raised rib 45 which extends perpendicularly from center plate 40 to form the outside of end portion 37. The end portion 37 is integral with a center portion 46, which includes a center plate 47 and an outer raised rib 48 on each side of plate 47, integral with rib 45, and which engages an angularly related plate 50 which extends to the end of rib 48, and forms a base end 49.

The rib 48 on each side includes a triangular plate 51, which is thinner than rib 48, to provide a step 52, and which is integral with plate 50.

Plate 50 on each side thereof has a triangular shaped plate 53 extending downwardly therefrom that are perpendicular thereto, which plates 53 are joined by a transverse connecting plate 54, that is also integral with plate 50. The plate 54 has a triangular cutout 55, and a boss 56 in the center of plate 54, which extends to and is integral with plate 50. The boss 56 has an opening 57 to receive a screw (not shown) for attachment to a base 60 to be described.

Figure 4:
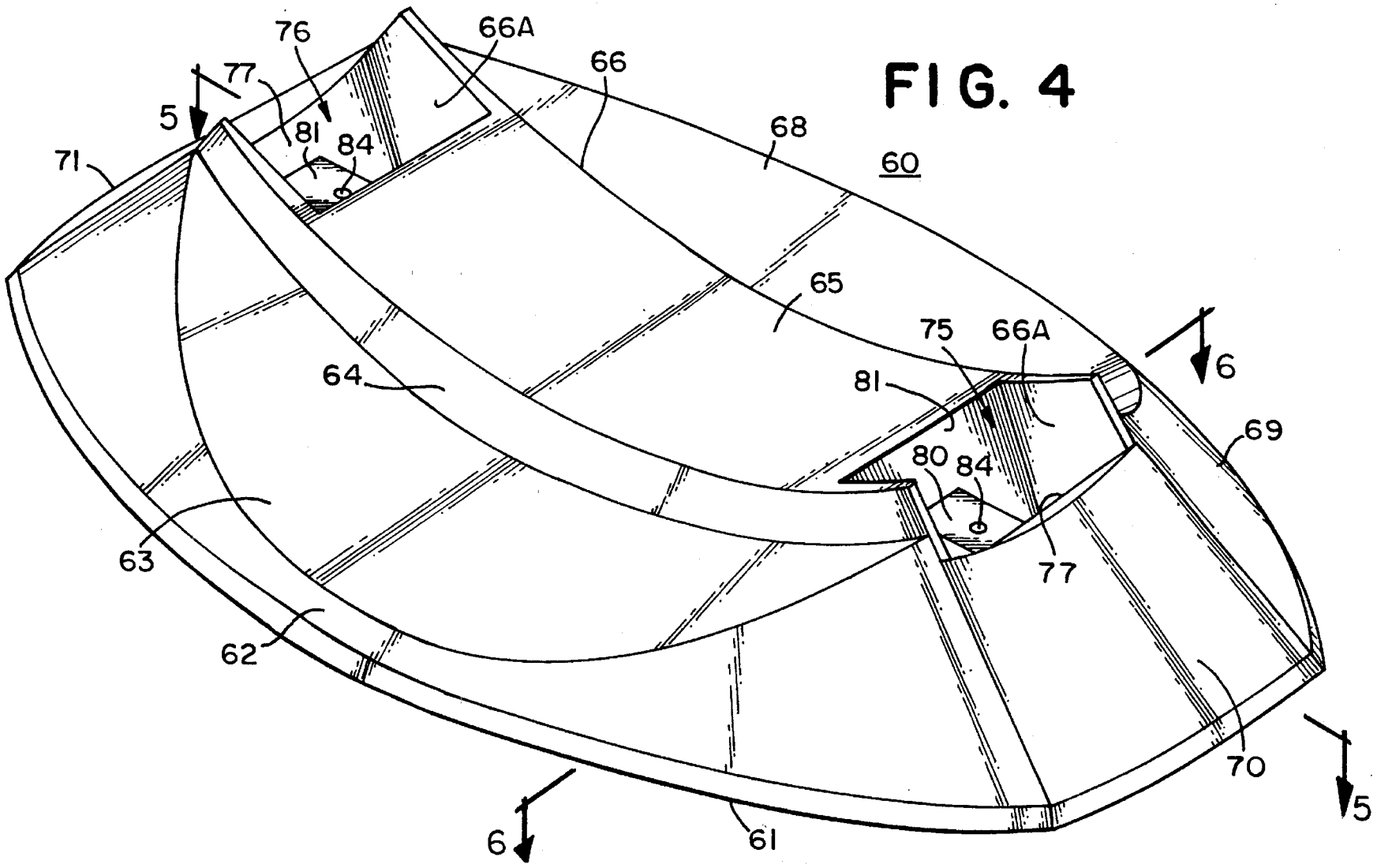
FIG. 4 is a perspective view, enlarged of the base portion of the assembly of the invention.
Figure 5:
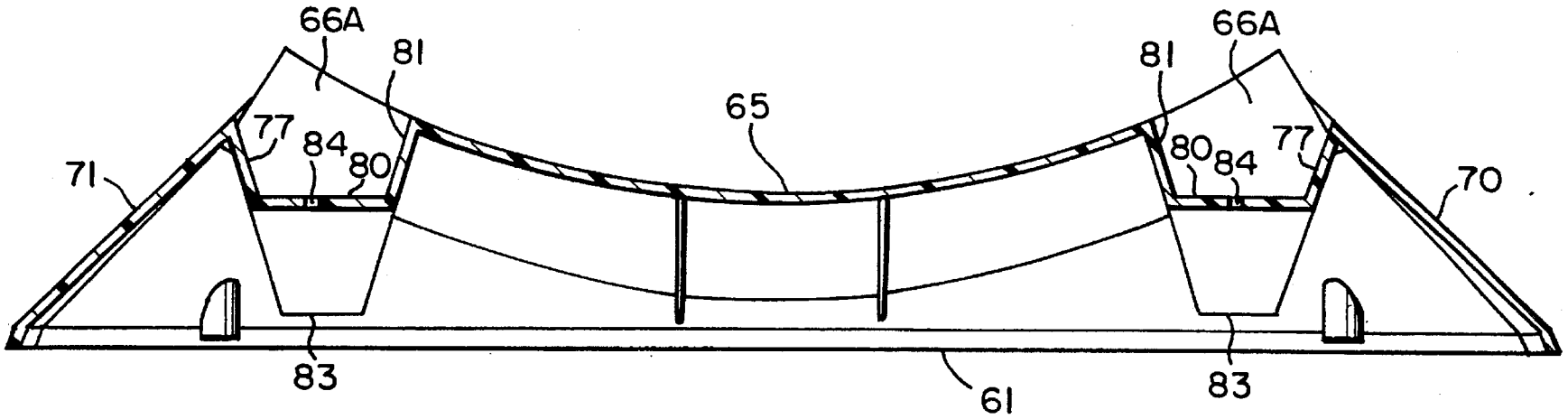
FIG. 5 is a vertical sectional view taken approximately on the line 5—5 of FIG. 4.
Figure 6:
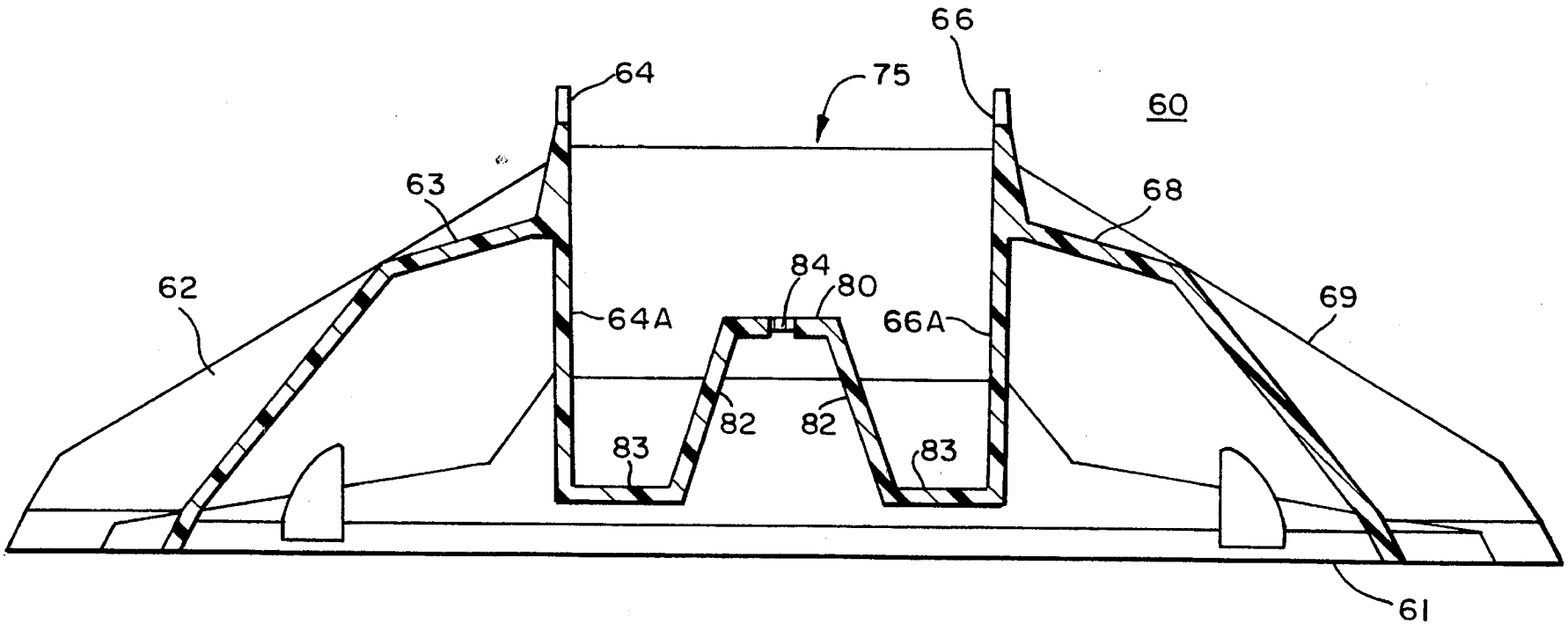
FIG. 6 is a vertical sectional view taken approximately on the line 6—6 of FIG. 4.
Figure 7:
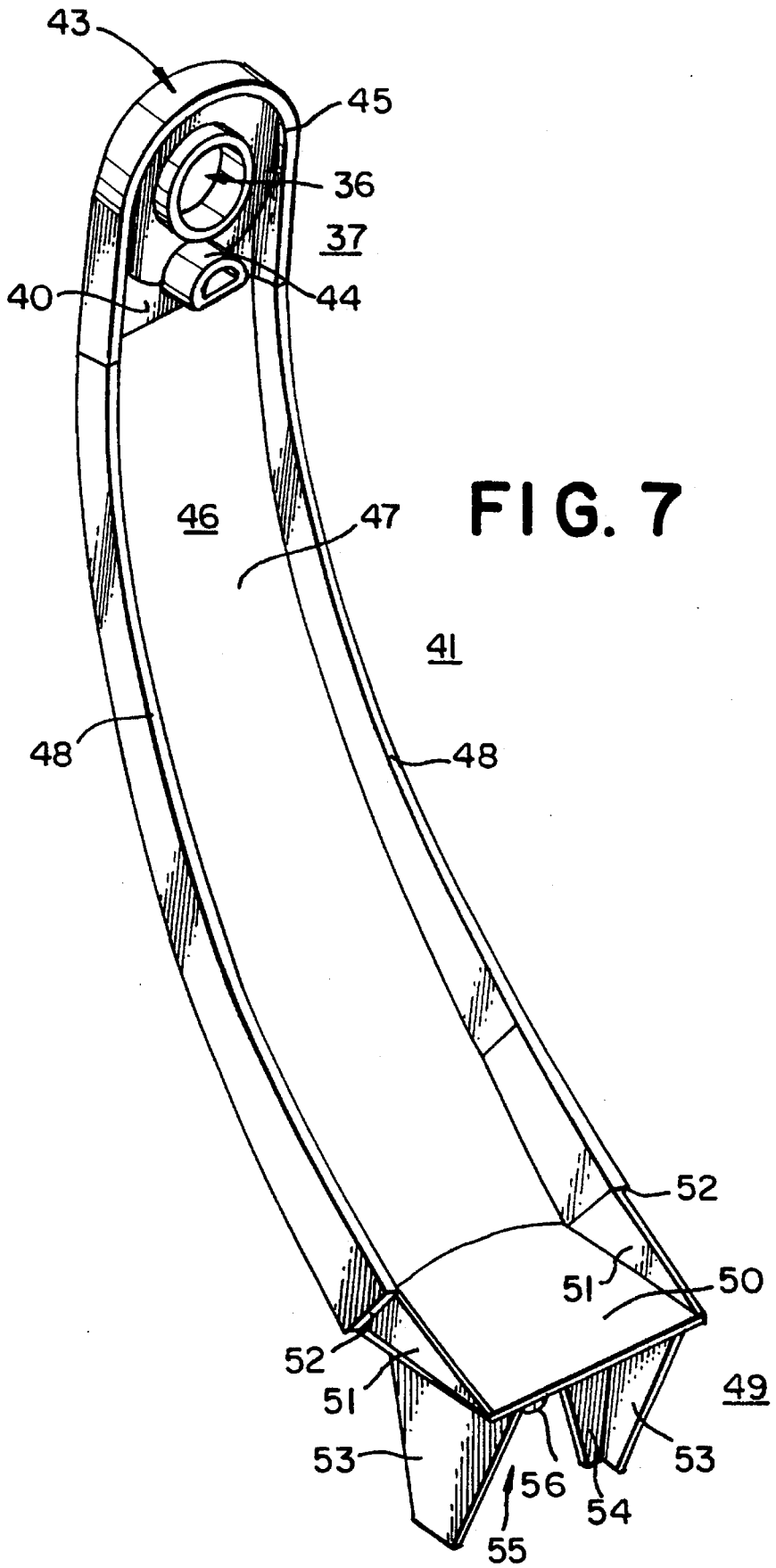
FIG. 7 is a view in perspective of a yoke member of the invention.

The base 60 is of generally rectangular, curvilinear shape with a flat bottom rim 61, which is intended to rest on a floor or other surface for support. The base 60 as shown in FIGS. 4, 5 and 6 includes a front wall 62 with a sloping center panel 63, which terminates at a vertical wall 64, which is of semi-circular configuration with a center panel 65, which follows its configuration and extends to a rear wall 66, of the same configuration as wall 64 and when taken together form the part of the yoke which is integral with the base 60. The base 60 has a rear sloping center panel 68, part of a rear wall. 69 of the same configuration as panel 63 and front wall 62. The base 60 has a right side wall 70, and a left side wall 71 which extend up from rim 61 and connect the front and rear walls 62 and 69.

The center panel 65 does not extend to the ends of walls 64 and 66, and the right and left side walls 70 and 71 do not extend to the ends of walls 64 and 66, thereby forming recesses 75 and 76. The recesses 75 and 76 each have a wall 77 which extends downwardly from walls 64 and 66 to a center wall 80, parallel to rim 61, which extends to a wall 81 which extends angularly downwardly from center panel 65.

The center wall 80 has a wall 82 on each side thereof, which extend down to bottom walls 83 which are also connected to extensions 64A and 66A of walls 64 and 66. The center wall 80 is provided with an opening 84 which is intended to receive screws (not shown), which are engaged in openings 57 in bosses 56 of yoke members 4 1.

The angular slope of walls 77, 80, 81, 82, and 83 match the corresponding plates 53, 54, and boss 56 to ensure a snug fit when assembled. The outer housing 11, the yoke members 41, and the base 60 are of injection molded plastic, and preferably polyethylene, but other suitable moldable plastic can be used as required.

To assemble the pivot fan, the yoke members 40 have their plates 53 inserted into recesses 75 and 76 of base 60 with the steps 52 inside and abutting walls 64 and 66, and screws (not shown) are inserted into Openings 84 and 57, and tightened thereby Securing the yoke members 40 in place. The configuration of base end 49 of the yoke member 41, which fits snugly in the recesses 75 and 76 interlocks the yoke members 41 in place. The housing 11 is attached to the end portions 37 of yoke members 41, and rotated to the desired position.

It will thus be seen that the structure has been provided with which the objects of the invention are achieved.

I claim:

1. A pivot fan which sits on a flat surface, which includes a fan outer housing having an electric fan motor and blade mounted in the housing for blowing air, the improvement for mounting said fan outer housing which comprises a pair of yoke members to which said outer fan housing is detachably engaged and which can be rotatably positioned therebetween;

said yoke members each having a yoke base end;

a semi-rectangular base which sits on a flat surface;

a pair of recesses in said base to receive said yoke base ends, and means to secure said yoke member base ends in said recesses.

2. A pivot fan as defined in claim 1 in which said recesses are provided with a plurality of angularly related walls, and said yoke base ends have triangular plates and walls matching said recess walls, for interlocking therewith.

3. A pivot fan as defined in claim 1 in which said yoke members and said fan outer housing are provided with interengaging rotational positioning stop means.

4. A pivot fan as defined in claim 1 in which said yoke members and said base are of molded plastic.

* * * * *